US007137937B2

(12) United States Patent
Croft

(10) Patent No.: US 7,137,937 B2
(45) Date of Patent: Nov. 21, 2006

(54) COLLAPSIBLE RESISTANCE EXERCISE DEVICE

(75) Inventor: Ellen Croft, 416 N. Salsipuedes St., Santa Barbara, CA (US) 93103

(73) Assignee: Ellen Croft, Santa Barbara, CA (US)

( * ) Notice: Subject to any disclaimer, the term of this patent is extended or adjusted under 35 U.S.C. 154(b) by 3 days.

(21) Appl. No.: 10/899,683

(22) Filed: Jul. 26, 2004

(65) Prior Publication Data

US 2005/0059536 A1 Mar. 17, 2005

Related U.S. Application Data

(63) Continuation-in-part of application No. 10/266,443, filed on Oct. 7, 2002, now Pat. No. 6,971,975.

(51) Int. Cl.
*A63B 21/00* (2006.01)

(52) U.S. Cl. ..... 482/142; 482/121

(58) Field of Classification Search ..... 482/121, 482/129, 904, 126, 137, 112, 907, 130, 140, 482/38, 39, 41, 42, 142, 122, 136, 135
See application file for complete search history.

(56) References Cited

U.S. PATENT DOCUMENTS

| | | | | |
|---|---|---|---|---|
| 2,782,033 | A | 2/1957 | Ugartechea | |
| 3,127,171 | A * | 3/1964 | Noland et al. | 482/94 |
| 3,874,657 | A * | 4/1975 | Niebojewski | 482/104 |
| 4,844,448 | A | 7/1989 | Niznik | |
| 5,320,591 | A * | 6/1994 | Harmon et al. | 482/129 |
| 5,343,463 | A | 8/1994 | van Tetering et al. | |
| 5,385,525 | A | 1/1995 | Davis | |
| 5,405,306 | A * | 4/1995 | Goldsmith et al. | 482/120 |
| 5,450,394 | A | 9/1995 | Gruber | |
| 5,477,631 | A | 12/1995 | McKee | |
| 5,600,632 | A | 2/1997 | Schulman | |
| 5,626,546 | A * | 5/1997 | Little | 482/129 |
| 5,878,032 | A | 3/1999 | Mirek et al. | |
| 6,148,051 | A | 11/2000 | Fujimori | |
| 6,172,989 | B1 | 1/2001 | Yanagihara et al. | |
| 6,203,473 | B1 * | 3/2001 | Atwood | 482/95 |
| 6,233,256 | B1 | 5/2001 | Dieterich et al. | |
| 6,252,891 | B1 | 6/2001 | Perches | |
| 6,328,679 | B1 | 12/2001 | Croft | |
| 6,336,192 | B1 | 1/2002 | Sakamoto | |
| 6,360,332 | B1 | 3/2002 | Weinberg | |
| 6,446,121 | B1 | 9/2002 | Shah | |
| 6,545,979 | B1 | 4/2003 | Poulin | |
| 6,557,110 | B1 | 4/2003 | Sakamoto | |
| 6,601,098 | B1 | 7/2003 | Case et al. | |
| 6,699,162 | B1 * | 3/2004 | Chen | 482/140 |
| 2004/0067828 | A1 | 4/2004 | Croft | |

* cited by examiner

*Primary Examiner*—Jerome Donnelly
(74) *Attorney, Agent, or Firm*—Manatt Phelps Phillips

(57) ABSTRACT

A collapsible resistance exercise device for compact storage and quick deployment includes a horizontally disposed base support frame and an upright frame pivotally attached to the base frame. The upright frame includes a resistance bar pivotally mounted thereon. In practice, the device is placed on a level surface with the base support frame resting on the surface. The free end of the upright frame is rotated upwardly to a vertical position where it is releasably locked into position to be free standing. One end of a pair of springs are attached to spring attachment loops disposed on the upright frame. The opposing ends of the springs are attached to spring attachment loops disposed on a resistance bar, strap or similar device. The exerciser exercises a muscle group by contacting a limb with the resistance bar and repetitively moving the resistance bar against the restoring force of the springs.

3 Claims, 9 Drawing Sheets

COLLAPSIBLE RESISTANCE EXERCISE DEVICE

RELATED APPLICATIONS

This application is a continuation-in-part of application Ser. No. 10/266,443, filed Oct. 7, 2002, now U.S. Pat. No. 6,971,975, the entirety of which is hereby incorporated herein by this reference.

FIELD OF THE INVENTION

The present invention relates to a resistance exercise equipment and, more particularly, to a collapsible, pilates-type device for personal exercise.

BACKGROUND OF THE INVENTION

Wall-mountable resistance-type exercise devices are well known in the art. Various embodiments of such devices are disclosed, for example, in U.S. Pat. Nos. 5,468,205, 5,431,617, 4,402,504 and 5,385,525. Little, in U.S. Pat. No. 5,626,546, the contents of which patent is incorporated herein by reference thereto, provides a review of such prior art devices and discloses a wall-mountable resistance-type exercise device that overcomes many of the limitations present in prior art devices. Little's device has a matched pair of slotted rails adapted to be vertically mounted on a vertical surface. A matched pair of swing arms are rotatably mounted on slidably adjustable universal blocks disposed within the slots. The opposing ends of the swing arms are attached to a resistance bar and an elastic resistance member. The points of attachment of both the swing arms and the elastic resistance members to the slotted rails are incrementally adjustable along substantially the entire length of the slotted rails. A disadvantage of the device is the large number of parts required to make the device operational.

Resistance exercise devices that employ springs for providing resistance to the movement of a limb of the body are known in the art. Croft, in U.S. Pat. No. 6,328,679, the content of which patent is incorporated herein by reference thereto, discloses a compact, low profile, wall-mountable exercise device ("the Croft device" or, in the alternative, a "Croft-type device"). The Croft device includes a modular, wall-mountable rectangular frame, a horizontal hinge rod assembly attached to the frame and rotatably mounted on the frame, a resistance bar, a pair of swing arms, each swing arm having a distal end attached to opposing ends of the hinge rod, and proximal ends attached to opposing ends of the resistance bar. The Croft device includes at least two springs, each spring having a proximal end and a distal end. The distal ends of the springs are releasably attached to spring connectors on the frame. The proximal ends of the springs are attached to the respective swing arms near the proximal ends thereof. In use, an exerciser positions a part of his/her body, such as the hands, in contact with the resistance bar and applies a force sufficient to extend the springs. When the exerciser releases the force, the spring restores to its non-extended length. The exerciser repeats the cycle until the targeted body part(s) is sufficiently exercised. The various possible attachment points for the distal ends of the springs enable the device to be used for exercising various muscles of the body, including the arms, shoulders, legs, back, chest and abdomen. The device is not readily transportable and requires a permanent wall mount, which may not be aesthetically pleasing in a home setting. There is, therefore, a need for a versatile resistance-type exercise device that is quickly and easily assembled and may be collapsed when not in use for convenient storage and/or transport.

In co-pending application Ser. No. 10/266,443, filed Oct. 7, 2002, and published Apr. 8, 2004, as US 2004/0067828, Croft discloses a device that is similar to the '679 device but is not wall-mountable. The device, which is collapsible, is provided with a low-profile storage case that serves as a base of support and by which the device may be conveniently transported and stored.

There is a continuing need for a versatile resistance-type exercise device that is quickly and easily assembled and may be collapsed when not in use for convenient storage and/or transport.

DESCRIPTION OF THE PREFERRED EMBODIMENTS

A collapsible resistance exercise device in accordance with the invention has a low profile when collapsed and may be quickly deployed and readied for use by an exerciser without the need for tools or the assembly of separable parts other than the attachment of springs to the device.

Figure 1:
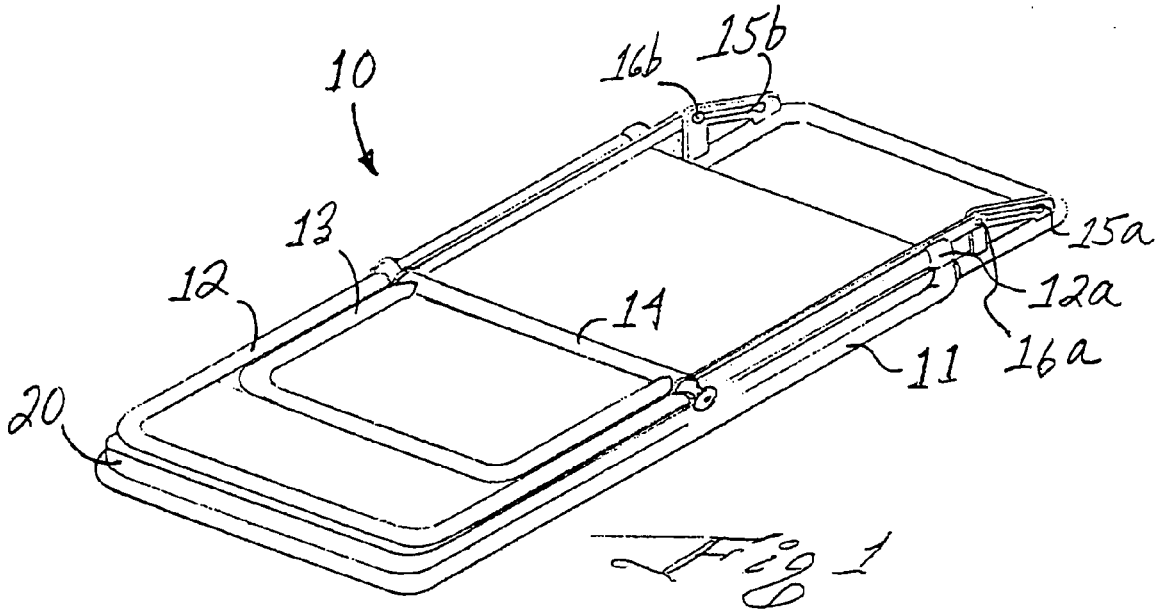
FIG. 1 is a perspective view of an exercise device in accordance with the present invention wherein the device is collapsed for storage.

FIG. 1 is a perspective view of an exercise device 10 in accordance with the present invention wherein the device 10 is collapsed for storage. The device 10 has a base support frame 11 with a lower end 12*a* of an upright frame 12 pivotally attached thereto. A resistance bar 13 is attached to a transverse bar 14 pivotally mounted on the upright frame 12. A pair of guide slots 15*a* and 15*b* receive guide pins 16*a* and 16*b* into a detent on the rearward end of the guide slots when the upright frame 12 is raised to an upright position as shown in FIG. 2.

Figure 2:
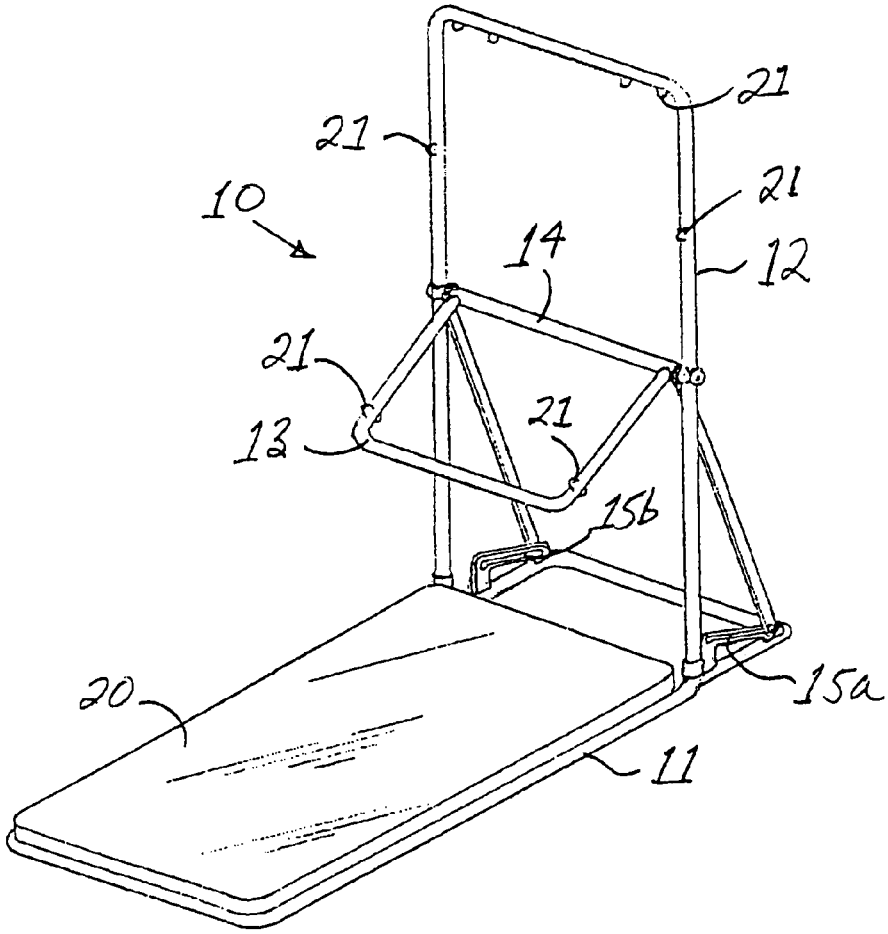
FIG. 2 is a perspective view showing the device of FIG. 1, without springs attached thereto, deployed for exercising.

FIG. 2 is a perspective view showing the device of FIG. 1, without springs attached thereto, deployed for exercising. The upright frame 12 includes a plurality of spring attachment loops 21 affixed thereto that provide means for attaching an end of a spring to the device. The forward end of the guide slots 15*a* and 15*b* also provide means for attaching a spring to the device 10. A pad 20 is provided to support the body of an exerciser as shown in FIG. 3.

Figure 3:
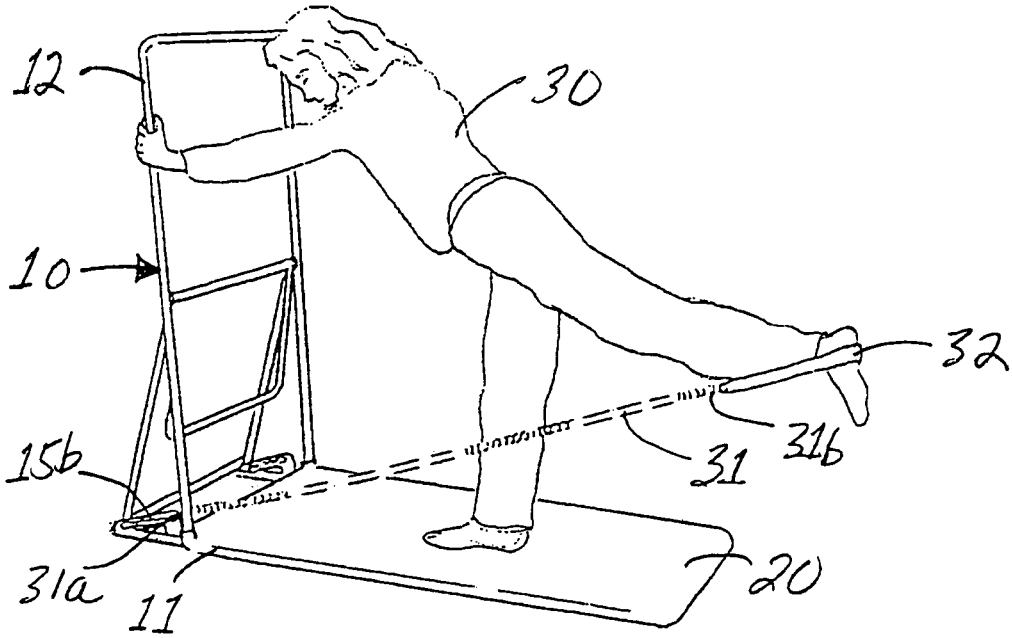
FIG. 3 is a perspective view of the device showing an exerciser using the device to exercise muscles associated with the left leg and hip.

FIG. 3 is a perspective view of the device 10 showing an exercisor 30 using the device to exercise muscles associated with rearward extension of the left leg and hip. The forward end 31*a* of a spring 31 is shown attached to the forward end of the guide slot 15*b* and the rearward end 31*b* of spring 31 is attached to a strap 32 which provides means for the exercisor 30 to place the left foot in order to extend and relax the spring 31.

Figure 4:
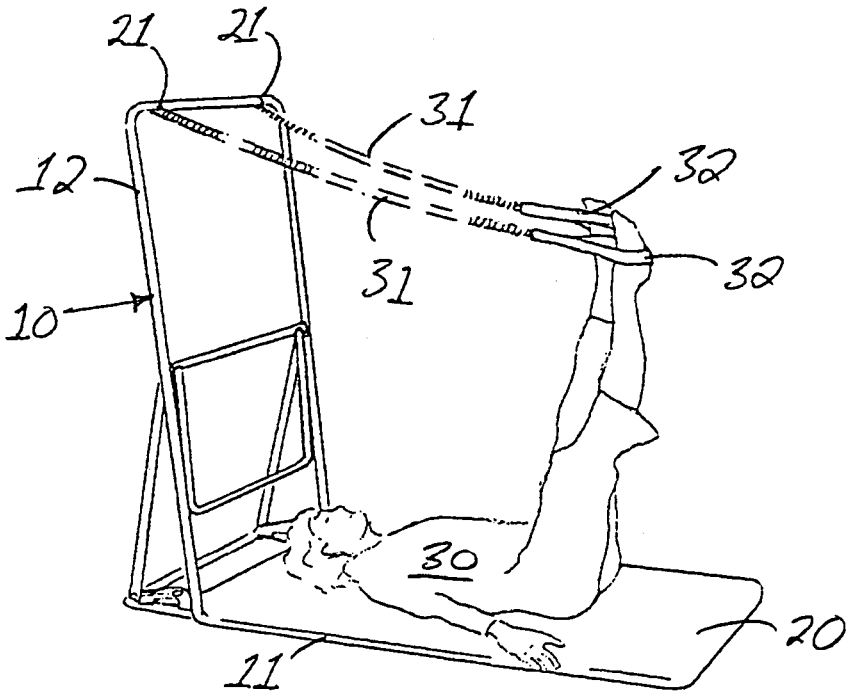
FIG. 4 is a perspective view of the device showing an exerciser using the device to exercise muscles associated with the both legs and hips.
Figure 5:
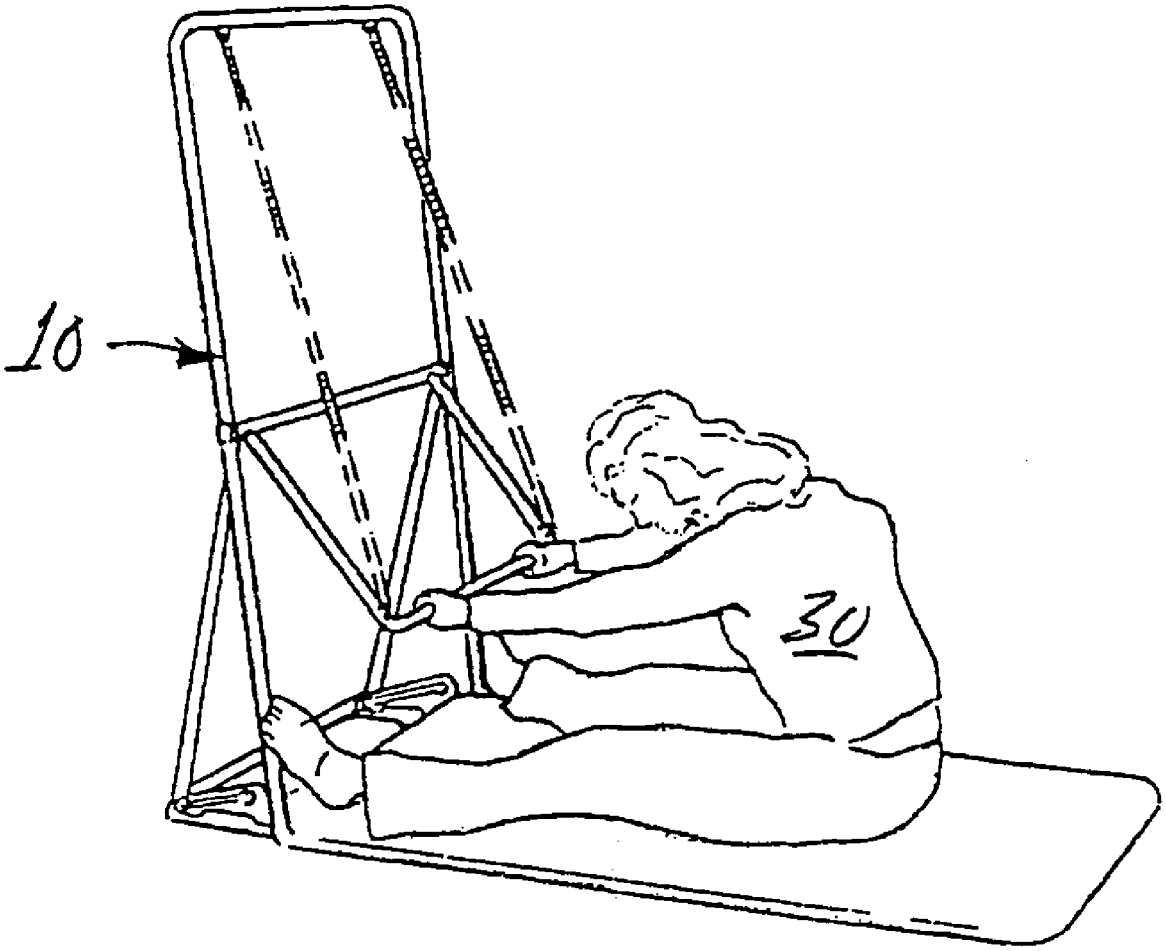
FIG. 5 is a perspective view of the device showing an exercisor using the device to perform pull-down/push-down type exercises.

FIG. 4 is a perspective view of the device 10 showing an exercisor 30 using the device to exercise muscles associated with both of the exercisor's legs and hips. The rearward ends of the springs 31 are attached to spring attachment loops 21 on the upright frame and the rearward end of the springs are attached to straps 32. FIG. 5 is a perspective view of the device showing an exercisor using the device in a sitting position to perform pull-down/push-down type exercises.

Figure 6:
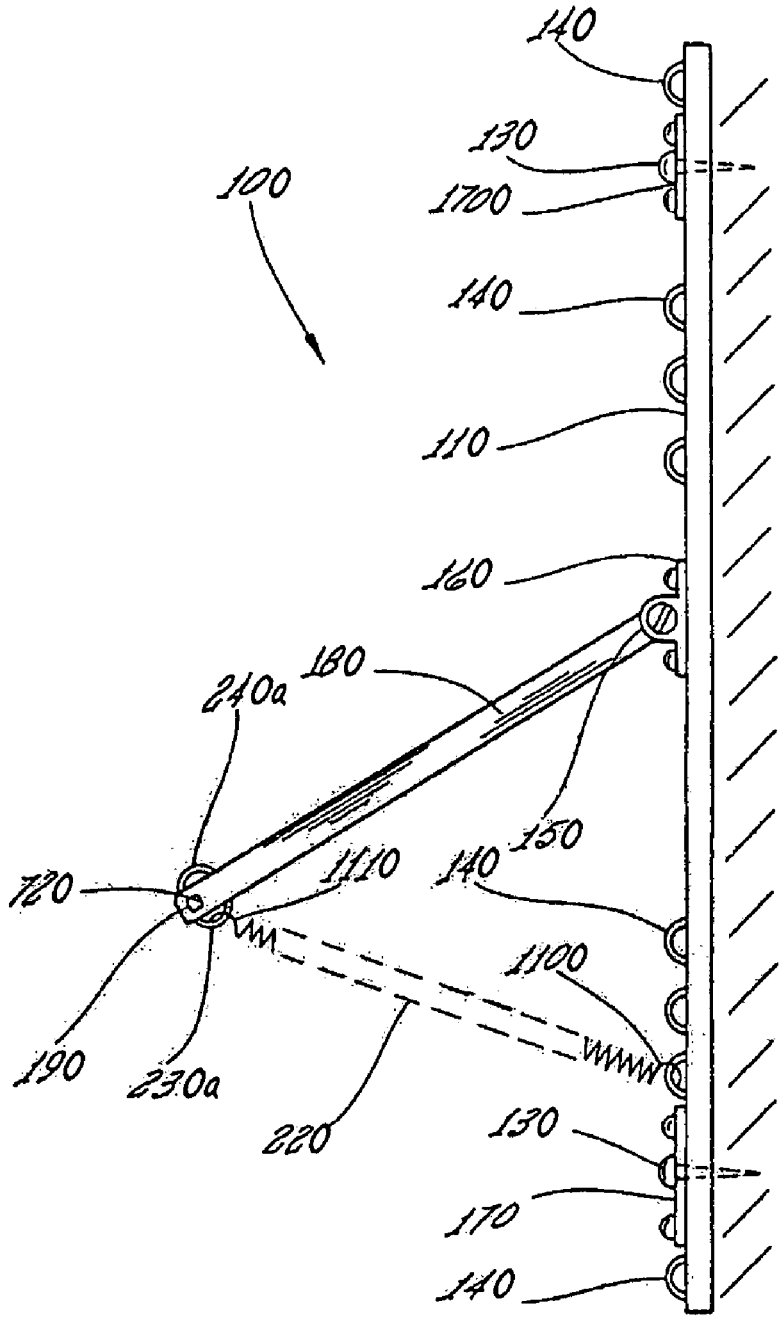
FIG. 6 is a side view of a wall-mounted exercise device.
Figure 7:
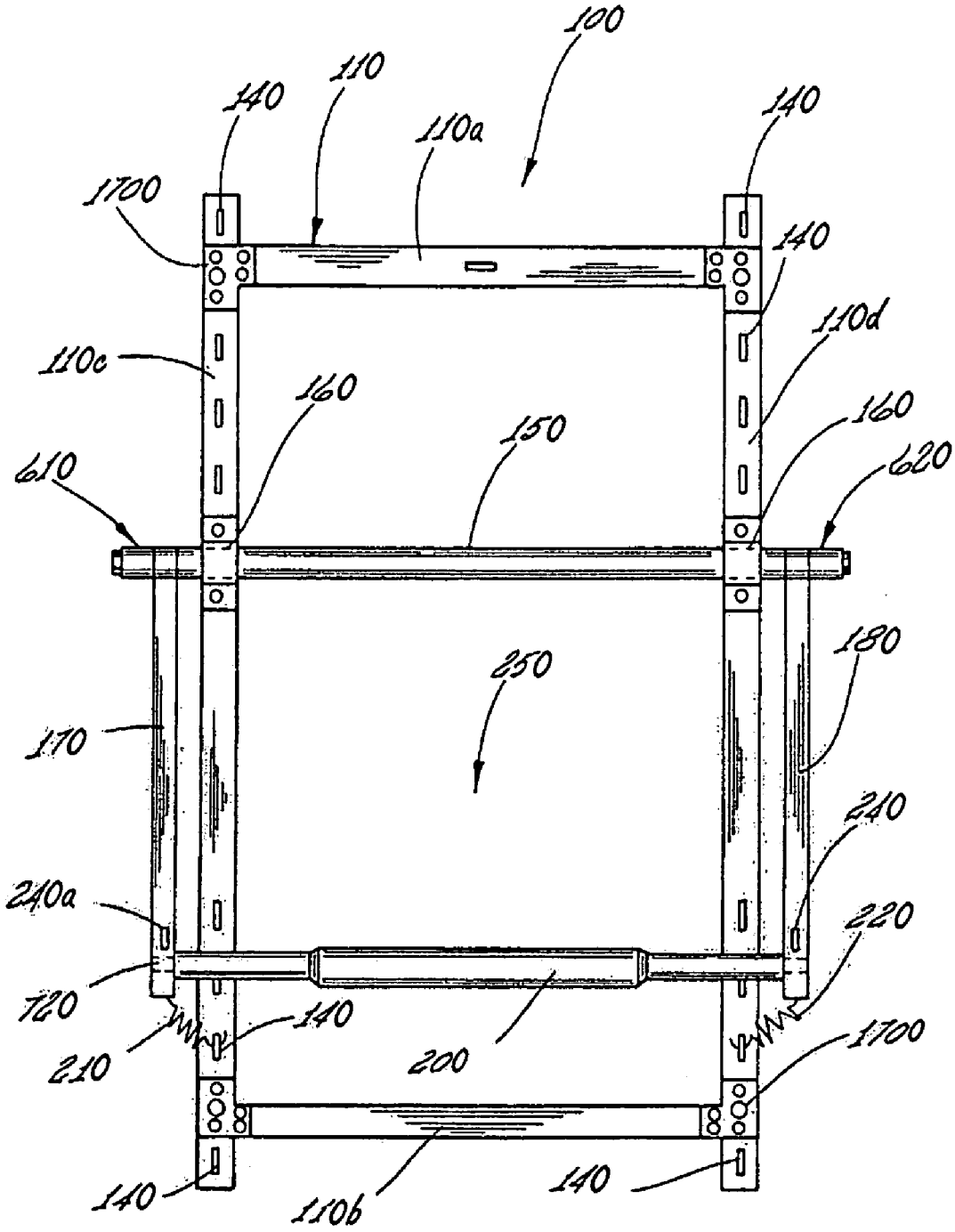
FIG. 7 is a front view of the wall-mounted exercise device of FIG. 6 with the springs removed.
Figure 11:
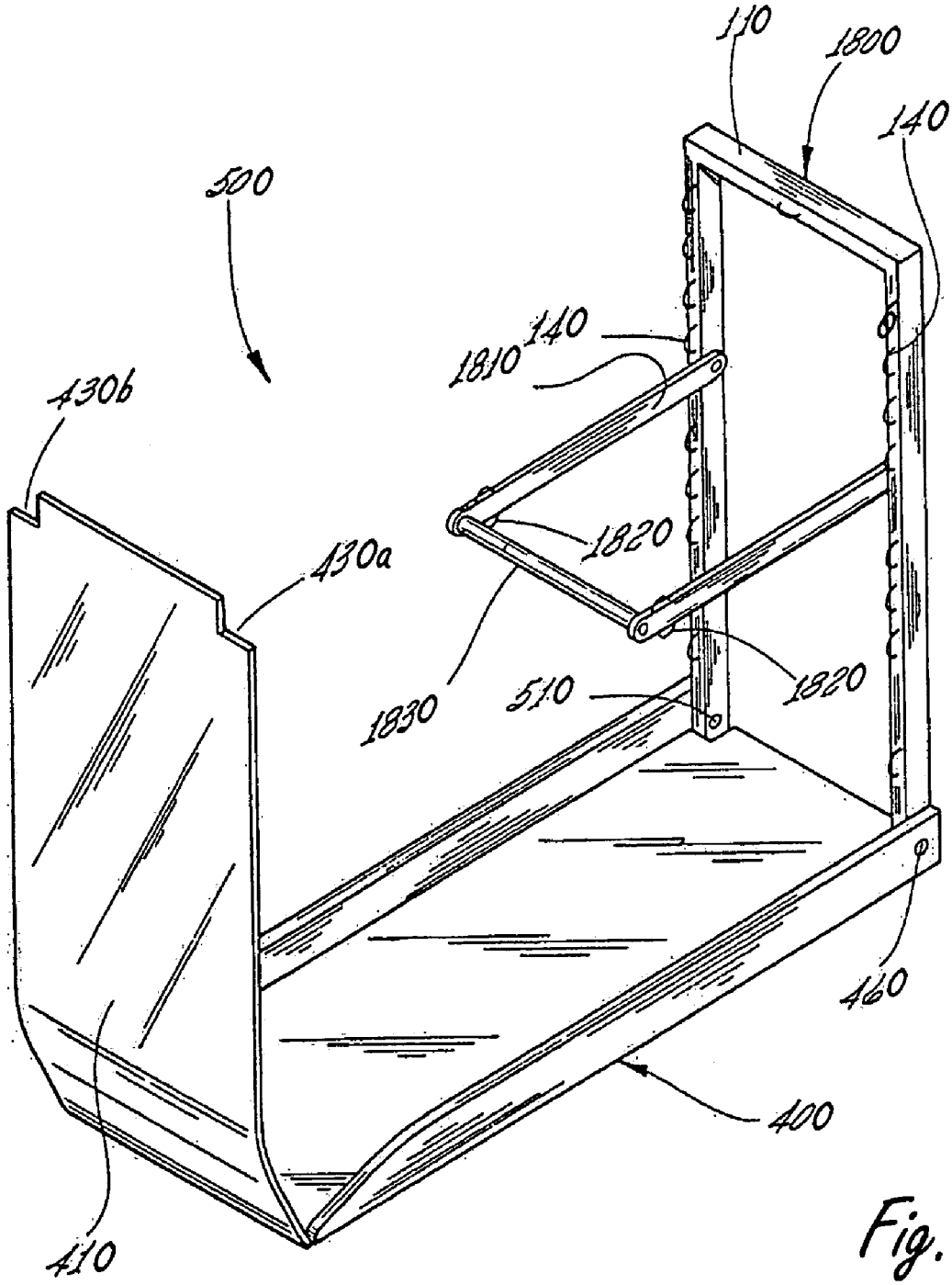
FIG. 11 is a perspective view of a transportable Croft-type exercise device of FIG. 10 with the frame of the exercise device elevated in preparation for use.

Turning to FIGS. 6 and 7, a wall-mountable exercise device (hereinafter referred to as "the Croft device"), disclosed in U.S. Pat. No. 6,328,679 to the present inventor, is generally indicated at numeral 100. The Croft device 100 includes a rectangular frame 110 attached to a wall 120 by frame mounting means 130 such as, for example, screws. The frame 110 includes a plurality of spaced spring attachment loops 140 integral therewith. A transversely oriented hinge bar 150 is rotatably attached to the frame by a pair of hinge bar mounting brackets 160 affixed to the frame 110. The hinge bar 150 has left and right ends, labeled 610 and 620 in FIG. 11, extending laterally from the hinge bar mounting brackets 160.

The Croft device 100 includes a left swing arm 170 (not visible in FIG. 6) and a right swing arm 180. A distal end of both swing arms are rotatably attached to the respective left and right ends 610 and 620 of the hinge bar 150. The opposing, proximal ends of the left and right swing arms are non-rotatably attached to left and right ends of a resistance bar 250 which provides a gripping surface for an exerciser's hands. Resistance to motion of the resistance bar is provided by left and right extensible springs 210 (not visible in FIG. 6) and 220. A distal end of the springs include a hook 1100 thereon which releasably engages one of the plurality of spring attachment loops 140 on the frame. A hook 1111 on the proximal ends of the respective springs releasably engages one of the spring attachment loops 230*a*, 230*b*, 240*a* or 240*b* disposed on the proximal ends of the respective swing arms.

An important feature of the Croft device 100 is that the device 100 has fewer separable parts than previous prior art devices and the modular construction permits shipping the device as a kit that is easily assembled. The frame 110 comprises an upper horizontal member 110*a*, a lower horizontal member 110*b*, a left vertical member 110*c* and a right vertical member 110*d*. The four members comprising the frame preferably have mitered corners and are affixed to one another by frame attachment plates 1700 to form a rectangle as shown in FIG. 7. The overall dimensions of the frame 110 are 47 inches high and 18.5 inches wide. The four members comprising the frame and the four frame attachment plates are most preferably aluminum. A plurality of spring attachment loops 140 are disposed along the length of the vertical members 110*c* and 110*d* and spaced from one another by a distance of about 3 inches. The spring attachment loops 140 are integral with the frame 110 and are made by die punching the wall of the vertical members to cut two slots and stretching the material between the slots outwardly to form a loop.

In operation, an exerciser places a targeted portion of the body in contact with the resistance bar and exerts a force on the resistance bar sufficient to move the resistance bar thereby extending the spring against a restoring force. The force required to displace the resistance bar and extend the spring is substantially constant over the range of motion. The resistance bar is then allowed to return to its initial position and the motion repeated until the targeted body portion is sufficiently exercised. The selection of spring attachment hooks 14 on the frame that are available to the exerciser for anchoring the distal hook 1100 of the spring makes it possible to exercise a variety of muscles within the body.

Figure 8:
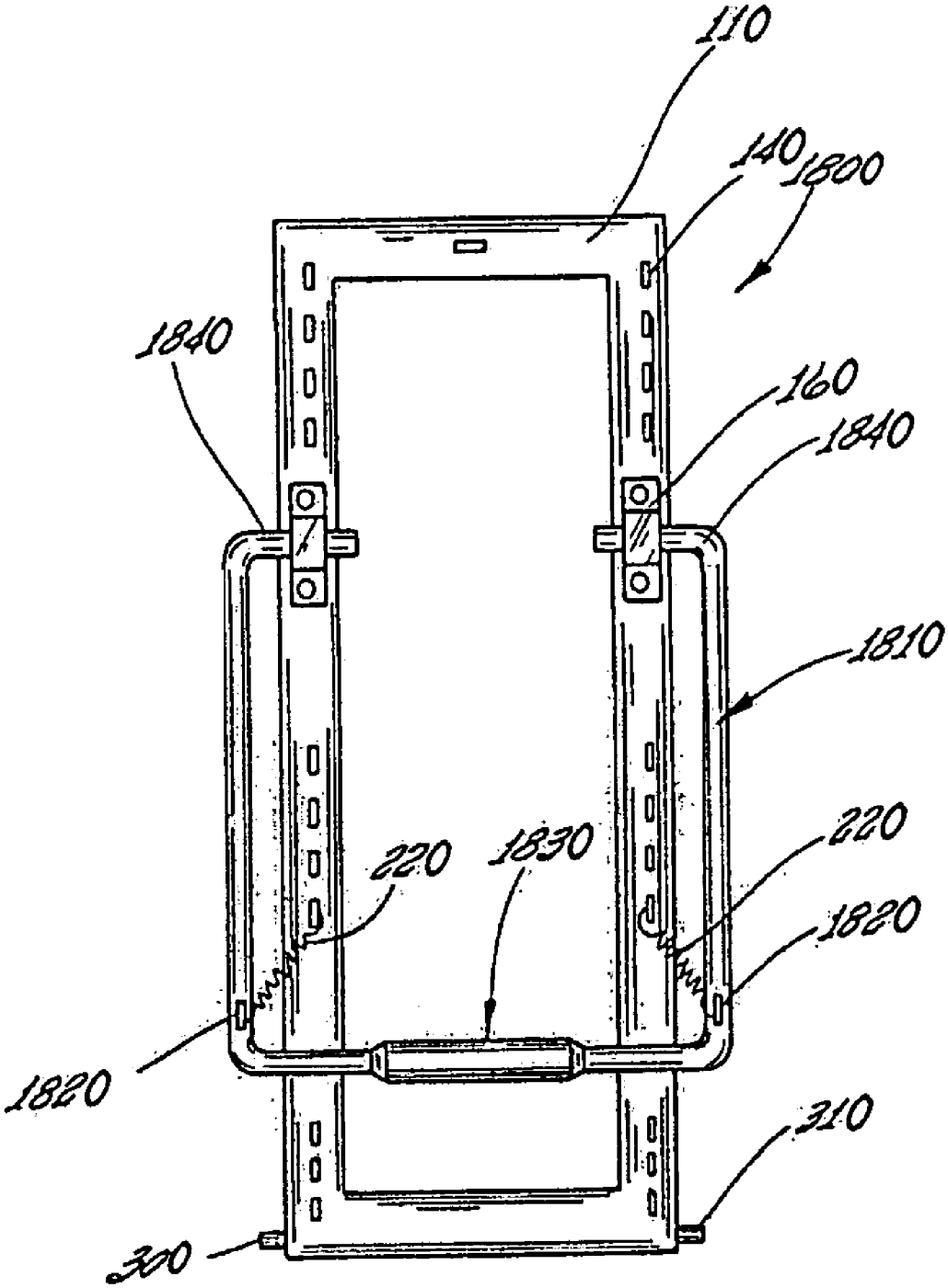
FIG. 8 is a front view of a second embodiment of the Croft device modified to provide pivotal attachment means for the pivotal attachment of the frame to a storage case.

A further embodiment of a wall-mountable Croft device is shown at numeral 1800 in FIG. 8. In the embodiment 1800, the frame 110 is of unitary construction, wall-mountable and is preferably made of ⅛–¼ inch aluminum plate or from four extruded aluminum members joined to form a rectangular frame by welding or the like. The hinge bar, swing arms and resistance bar are incorporated into a single unitary, substantially U-shaped resistance member 1810 that is rotatably attached to the frame 11 at two distal ends 1840. The unitary resistance member 1810, which has at least two spring attachment loops 1820 integral therewith adjacent a resistance bar portion 1830, is preferably extruded aluminum rod or tubing formed into a U-shape by bending the extruded member around a mandrel to the desired shape. In the embodiment 1800, the hinge bar mounting brackets 160 preferably include roller bearings press-fitted into the bore 1610 to reduce wear on the moving surfaces. Embodiment 1800 has six separable parts: a unitary frame 110, a unitary resistance member 1810, two hinge bar mounting brackets 160 and two springs 220.

Figure 9:
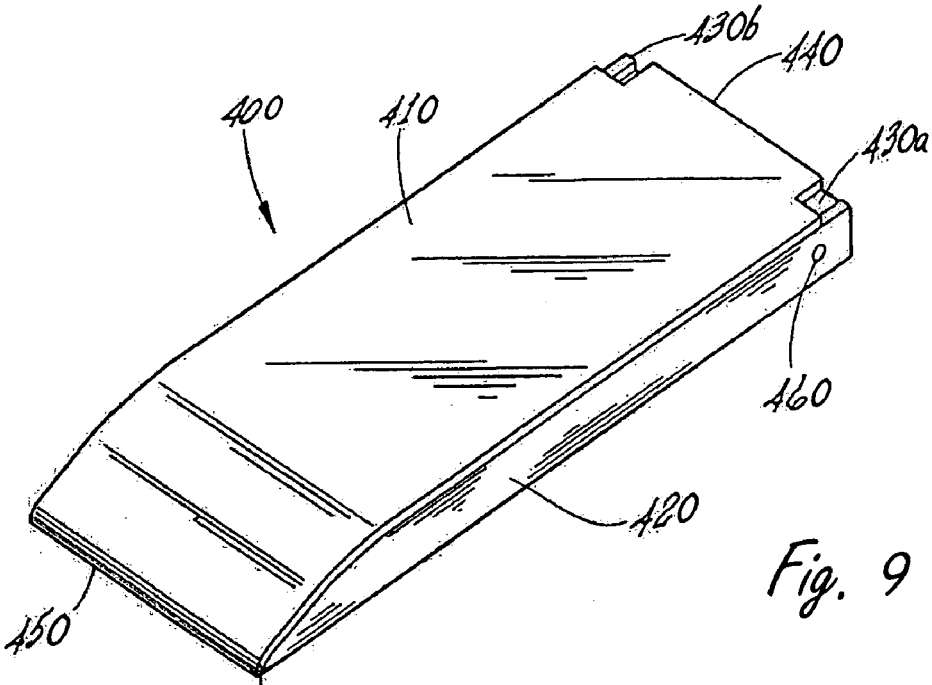
FIG. 9 is a perspective view of a storage case adapted for pivotal attachment to a Croft-type exercise device as shown in FIGS. 6–8.
Figure 12:
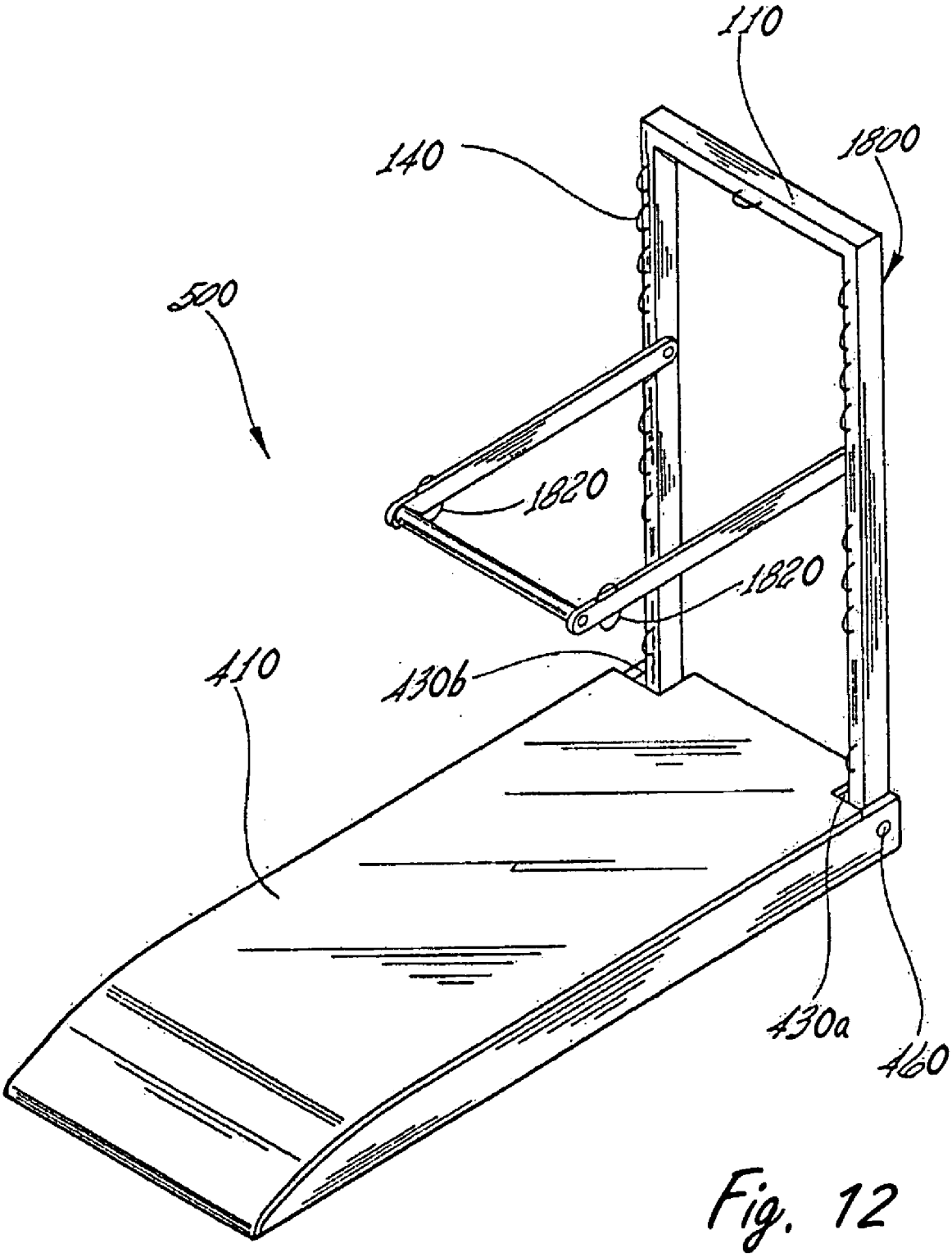
FIG. 12 is a perspective view of the transportable Croft-type exercise device in accordance with FIG. 11 with the lid of the storage case closed in preparation for use.

While wall-mountable Croft devices may be suitable for many installations, it may be desirable to transport the device such as, for example, in a vehicle, for use while traveling. The present invention discloses an exercise device comprising a storage case adapted for pivotal attachment to a modified frame 110 of a Croft device such as, for example, the embodiment 1800 of the Croft device shown in FIG. 8. The storage case, indicated in perspective view at numeral 400 in FIG. 9, is integral with the Croft device 1800. The storage case 400 provides stable support for the Croft device, obviates the need for wall-mounting the device and provides a compact, low-profile means for storing and transporting a Croft device when not in use. The storage case 400 includes a rectangular lid 410 having a fixed end 450 that is pivotally attached to a rectangular base 420 by means of a hinge 430. The lid 410 has a pair of notches 430*a* and 430*b* at a free end 440 thereof that serve to support the frame 110 of the Croft device 1800, wherein the frame 110 is modified to provide pivotal attachment means 510 thereon, when the modified frame of the device is erected for use as shown in FIG. 12. The base 420 of the storage case 400 includes a pair of cylindrical holes 460 dimensioned to receive pivotal attachment means 300 and 310 on the frame 110.

Figure 10:
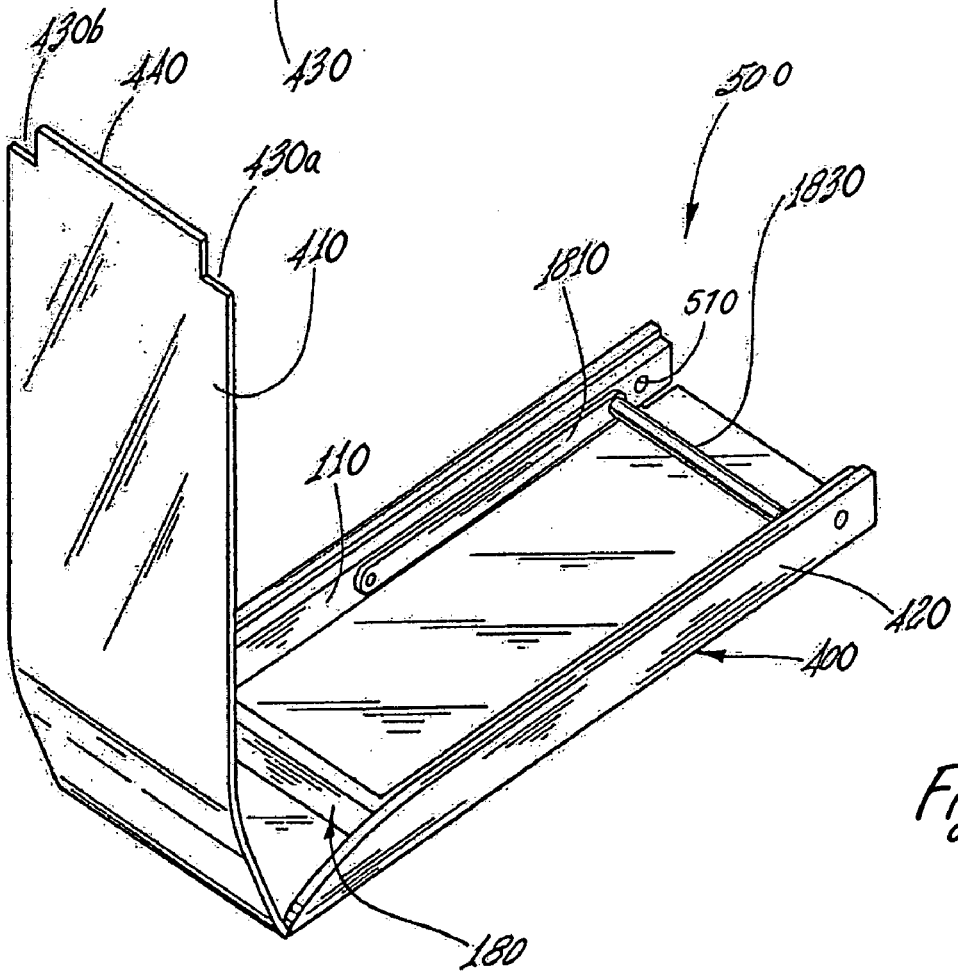
FIG. 10 is a perspective view of a transportable Croft-type exercise device in accordance with a preferred embodiment of the present invention with the lid of the storage case open to reveal the exercise device housed within the storage case.

With reference now to FIG. 10, an exercise apparatus comprising a Croft device 1800 pivotally attached to a storage case 400 is indicated in perspective view at numeral 500. The lid 410 of the storage case is shown opened to expose the Croft device 1800 housed therewithin. The frame 110 of the Croft device 1800 is pivotally attached to the storage case 400 by pivotal attachment means 510. The pivotal attachment means is preferably a pair of cylindrical axles 300 and 310 (FIG. 8) extending outwardly from the base of the frame to rotate within cylindrical recesses or holes 460 in the rectangular base 420 of the storage case 400. The frame, which may be U-shaped inasmuch as the lower horizontal member 110*b* of the prior art Croft device is not required, is erected by lifting the lid 410, rotating the frame upwardly from the confines of the storage case as shown in perspective view in FIG. 11 and closing the lid as shown in FIG. 12. When the frame is erected and the lid 410 closed, the notches 430*a* and 430*b* on the lid 410 fit snugly against the frame 110 to prevent the frame from collapsing into the storage case 400 when the device 500 is being used. Assembly includes the attachment of a pair of springs 220 (not shown in FIGS. 9–12) to the appropriate spring attachment loops 140 on the frame 110 and loops 1820 on the swing arms 1810 of the device to provide the desired resistance in the manner discussed above in the description of the assembly and operation of the wall-mounted Croft devices 100 and 1800. The exercise device 400 of the present invention is readily stored when not in use and easily transported.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A collapsible resistance exercise device comprising:

a base support frame configured for placement on a horizontal surface;

an upright frame including a lower end, an upper horizontal member, a left vertical member and a right vertical member, the lower end being pivotally attached to the base support frame, wherein the upright frame is configured to be releasably fixable in an upright position and to be collapsible onto the base support frame in a substantially flat relation;

a transverse support member disposed horizontally between the left vertical member and the right vertical member above the lower end and below the upper horizontal membe, the transverse support member being pivotally mounted to the upright frame;

a substantially U-shaped resistance member having a proximal resistance bar, a left distal end and a right distal end, the left distal end and the right distal end each being attached to the transverse support member;

a plurality of spring attachment fixtures disposed substantially symmetrically on the upper horizontal member, on the substantially U-shaped resistance member, and on a pivotal attachment between the upright frame and the base support frame; and at least one spring having at least one end configured for releasable engagement with at least one of the plurality of spring attachment fixtures.

2. The collapsible resistance exercise device of claim 1, further comprising a pad disposed on an upper surface of the base support frame.

3. The collapsible resistance exercise device of claim 1, further comprising a strap including at least one spring attachment fixture.

* * * * *